US010590770B2

(12) United States Patent
Griffin et al.

(10) Patent No.: US 10,590,770 B2
(45) Date of Patent: Mar. 17, 2020

(54) REVERSING MECHANISM FOR A POWER TOOL

(71) Applicant: Snap-on Incorporated, Kenosha, WI (US)

(72) Inventors: Paul W. Griffin, Kenosha, WI (US); Dennis A. Nowak, Franklin, WI (US); John R. Williams, Brasstown, NC (US)

(73) Assignee: Snap-on Incorporated, Kenosha, WI (US)

( * ) Notice: Subject to any disclaimer, the term of this patent is extended or adjusted under 35 U.S.C. 154(b) by 558 days.

(21) Appl. No.: 14/640,612

(22) Filed: Mar. 6, 2015

(65) Prior Publication Data

US 2016/0258291 A1 Sep. 8, 2016

(51) Int. Cl.

| | |
|---|---|
| ***F01C 20/04*** | (2006.01) |
| ***B25F 5/00*** | (2006.01) |
| ***F01C 1/344*** | (2006.01) |
| ***F01C 13/02*** | (2006.01) |
| ***F01C 20/24*** | (2006.01) |
| ***F01C 21/08*** | (2006.01) |
| ***F01C 21/10*** | (2006.01) |
| ***F01C 21/18*** | (2006.01) |
| ***F01C 20/14*** | (2006.01) |

(52) U.S. Cl.

CPC ..... *F01C 20/04* (2013.01); *B25F 5/001* (2013.01); *F01C 1/3441* (2013.01); *F01C 13/02* (2013.01); *F01C 20/14* (2013.01); *F01C 21/186* (2013.01)

(58) Field of Classification Search

CPC ..... F01C 20/04; F01C 1/3441; F01C 13/02; F01C 20/14; F01C 221/186; B25F 5/001

USPC ..... 173/218

See application file for complete search history.

(56) References Cited

U.S. PATENT DOCUMENTS

| | | | | |
|---|---|---|---|---|
| 2,077,733 A * | 4/1937 | Amtsberg | F01C 20/04 366/125 |
| 2,425,793 A * | 8/1947 | Fosnot | B25B 21/02 173/93.5 |
| 2,672,065 A | 3/1954 | Danuskie | |
| 2,678,577 A | 5/1954 | Tackett | |

(Continued)

FOREIGN PATENT DOCUMENTS

| | | |
|---|---|---|
| CA | 2097616 A1 | 12/1993 |
| CN | 101172338 A | 5/2008 |

(Continued)

OTHER PUBLICATIONS

Canadian Office Action, dated Sep. 21, 2016; 6 pages.

(Continued)

*Primary Examiner* — Nathaniel C Chukwurah
*Assistant Examiner* — Lucas E. A. Palmer
(74) *Attorney, Agent, or Firm* — Seyfarth Shaw LLP

(57) ABSTRACT

A reversing mechanism for a pneumatically or hydraulically powered tool having a rotor adapted to rotate in either of first and second rotational directions. The reversing mechanism allows a user to actuate a button and rotate a valve to direct air flow through the tool. By pressing the button, the button will move a base laterally, and in doing so, rotates the valve. Rotating the valve then aligns a barrier of the valve in a direction tangential to the selected rotational direction of the tool, better directing forced air or fluid and more efficiently distributing the air or fluid in the selected rotational direction.

19 Claims, 12 Drawing Sheets

(56) References Cited

U.S. PATENT DOCUMENTS 3,129,796 A * 4/1964 Karden ..... B25B 21/02 173/169
3,666,027 A * 5/1972 Sauerwein ..... B23B 45/04 173/169
3,833,068 A * 9/1974 Hall ..... B25B 23/1453 173/169
3,989,113 A * 11/1976 Spring, Sr. ..... B25B 21/00 137/625.69
5,199,460 A 4/1993 Geiger
5,303,781 A * 4/1994 Lin ..... B25F 5/00 173/169
5,377,769 A * 1/1995 Hasuo ..... B25B 21/02 173/169
5,918,686 A * 7/1999 Izumisawa ..... B25B 21/00 173/169
6,044,917 A * 4/2000 Brunhoelzl ..... B25B 21/00 173/168
6,062,323 A * 5/2000 Pusateri ..... B25B 21/00 173/169
6,488,451 B1 * 12/2002 Hartman ..... B25F 5/001 408/124
6,634,438 B1 * 10/2003 Pusateri ..... B25F 5/00 173/1
6,708,779 B2 * 3/2004 Taga ..... B25B 21/02 173/104
6,796,386 B2 * 9/2004 Izumisawa ..... B25B 21/02 173/93.5
6,880,645 B2 * 4/2005 Izumisawa ..... B25B 21/00 173/169
6,883,619 B1 * 4/2005 Huang ..... B25B 21/02 173/168
6,902,011 B2 * 6/2005 Hall ..... B25B 21/02 173/168
6,932,165 B1 * 8/2005 Sun ..... B25C 1/043 173/168
7,140,179 B2 * 11/2006 Bass ..... B25F 5/00 137/625.24
7,213,500 B2 * 5/2007 Chang ..... B25F 5/001 173/168
7,311,155 B2 * 12/2007 Chang ..... B25F 5/00 173/104
7,431,102 B2 * 10/2008 Hua ..... B25B 21/00 173/104
7,461,704 B2 * 12/2008 Chen ..... B25F 5/00 173/169
9,373,458 B2 * 6/2016 Welke ..... B25B 21/00
2004/0144553 A1 * 7/2004 Ashbaugh ..... B25F 5/00 173/169
2006/0102367 A1 * 5/2006 Etter ..... B25B 21/00 173/218
2008/0066937 A1 * 3/2008 Kobayashi ..... B25B 21/00 173/104
2008/0066941 A1 3/2008 Kobayashi
2008/0135271 A1 6/2008 Murphy
2008/0251269 A1 * 10/2008 Hua ..... B25B 21/00 173/104
2008/0264662 A1 * 10/2008 Chang ..... B25F 5/00 173/177
2011/0186315 A1 * 8/2011 Li ..... B23Q 5/00 173/16
2012/0138329 A1 6/2012 Sun
2012/0325510 A1 * 12/2012 Sun ..... B25B 21/02 173/91
2012/0325511 A1 * 12/2012 Cheng ..... B25B 21/00 173/169
2013/0075123 A1 * 3/2013 Sun ..... B25F 5/00 173/221
2013/0156622 A1 * 6/2013 Lee ..... B25B 21/00 417/545
2013/0186665 A1 * 7/2013 Hua ..... B25F 5/00 173/170
2014/0020923 A1 * 1/2014 Su ..... B25B 21/00 173/218
2014/0144553 A1 5/2014 Hata et al.
2016/0075008 A1 * 3/2016 Wu ..... B25B 21/00 173/221

FOREIGN PATENT DOCUMENTS

| | | | |
|---|---|---|---|
| CN | 201586966 | U | 9/2010 |
| EP | 1086784 | A | 5/2000 |
| EP | 2604387 | A2 | 6/2013 |
| JP | 2008073841 | A | 4/2008 |
| TW | 200642807 | A | 12/2006 |
| TW | 200827104 | A | 7/2008 |
| TW | 200827105 | A | 7/2008 |
| TW | M345685 | | 12/2008 |
| TW | M414304 | | 10/2011 |
| TW | 201236825 | A | 9/2012 |
| TW | 201323164 | A | 6/2013 |
| WO | 2012/098496 | A2 | 7/2012 |

OTHER PUBLICATIONS

United Kingdom Intellectual Property Office Combined Search and Examination Report, dated May 27, 2016;7 pages.
Australian Government Patent Examination Report No. 1, dated Feb. 26, 2016; 7 pages.
UK Intellectual Propery Office, Combined Search and Examination Report under Sections 17 and 18(3); dated Apr. 27, 2016; 7 pgs.
Taiwan Patent Office, Office Action dated Dec. 12, 2016.
Chinese Office Action for Application No. 201510985935.4 dated Aug. 24, 2017, 10 pages.
English translation of Chinese Office Action for Application No. 201510985935.4 dated Aug. 24, 2017, 2 pages.
Australian Office Action for Application No. 2017200447 dated Oct. 6, 2017, 4 pages.
Australian Examination Report No. 2 or Application No. 2017200447 dated Oct. 3, 2018, 6 pages.
United Kingdom Office Action for Application No. GB1522036.1, dated May 8, 2019, 3 pages.
United Kingdom Office Action for Application No. GB1907875.7, dated Jul. 4, 2019, 6 pages.

* cited by examiner

REVERSING MECHANISM FOR A POWER TOOL

TECHNICAL FIELD OF THE INVENTION

The present invention relates broadly to reversing mechanisms for pneumatic or hydraulic power tools. More particularly, the present invention relates generally to a reversing mechanism that selectively changes the rotational direction of a pneumatic or hydraulic power tool by redirecting air or fluid in a desired direction.

BACKGROUND OF THE INVENTION

Many tools are powered by pneumatic air or hydraulic fluid that provides the necessary pneumatic or hydraulic power to the tool. Impact wrenches, for example, can use pressurized air to impart torque to a work piece to loosen or tighten the work piece. At times, the rotational direction of the tool must be reversed, for example, when the work piece is left-hand threaded or when the user wishes to tighten the work piece instead of loosen it with the power tool.

Existing pneumatic and hydraulic tools include reversing mechanisms that selectively control the rotational direction of the tool. In some conventional pneumatic or hydraulic tools, the reversing mechanism is located on the rear of the tool, and can be a rotational knob that the user can use to select the desired rotational direction of the tool when rotated accordingly. In other tools, the reversing mechanism is an axially depressible button that changes the rotational direction of the tool by directing air or fluid in either of the clockwise or counterclockwise directions. These reversing mechanisms, however, are also typically located on the rear of the tool or in an otherwise hard to reach place, and not ergonomically located near the user's fingers during use of the tool, for example, near a trigger that causes the release of pressurized air or fluid. Such a location typically requires the user to disengage the tool from a work piece to change the rotational direction of the tool.

SUMMARY OF THE INVENTION

An embodiment of the present invention includes a reversing mechanism for pneumatically or hydraulically powered tools that converts axial motion of a mechanical button into rotational motion of a valve disposed in the tool to selectively change a rotational direction of the tool. A user can selectively depress the button to select, for example, either of clockwise or counterclockwise rotational directions of the tool. By depressing the button, the button linearly moves an internally disposed base, and thus rotates a valve coupled to the base. Rotation of the valve aligns a barrier disposed on the valve in to a position to direct pressurized air or fluid into a rotor housing in a direction substantially tangential to the selected rotational direction of the tool.

Another embodiment of the present invention broadly comprises a tool having a motor with a rotor adapted to be operated pneumatically or hydraulically to rotate in either of first and second rotational directions, such as clockwise and counterclockwise, and a reversing mechanism adapted to allow a user to select either of the first and second rotational directions.

The reversing mechanism includes a base having first and second openings, first and second buttons respectively coupled to the base in the first and second openings and opposingly disposed on the tool (e.g., the first button disposed on the left side of the tool and the second button disposed on the right side of the tool), and a valve rotatably or movably coupled to the base, such that axial movement of the first or second buttons causes the valve to rotate and direct air or fluid in a desired direction to cause the tool to rotate in either of the first and second directions.

Another embodiment comprises a reversing mechanism including a base having first and second openings, first and second buttons respectively coupled to the base in the first and second openings to allow a user to select either of first and second rotational directions for the tool, based on which of the first and second buttons are depressed, and a valve rotatably coupled to the base such that axial movement of the first or second button causes the valve to rotate and direct air or fluid in a desired direction to cause the tool to rotate in either of the first or second rotational direction.

Yet another embodiment comprises a method of operating a tool including providing a valve rotatable between first and second positions, wherein the valve is adapted to direct air or fluid in a first direction when disposed in the first position to cause the tool to rotate in a first direction, and a second direction when disposed in the second position to cause the tool to rotate in a second direction, actuating the first button in an axial direction, thereby causing a valve operably coupled to the first button to rotate to the first position, and actuating the trigger to cause air or fluid to dispense, thereby causing the tool to rotate in the first rotational direction.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION OF THE EMBODIMENTS

Figure 1:
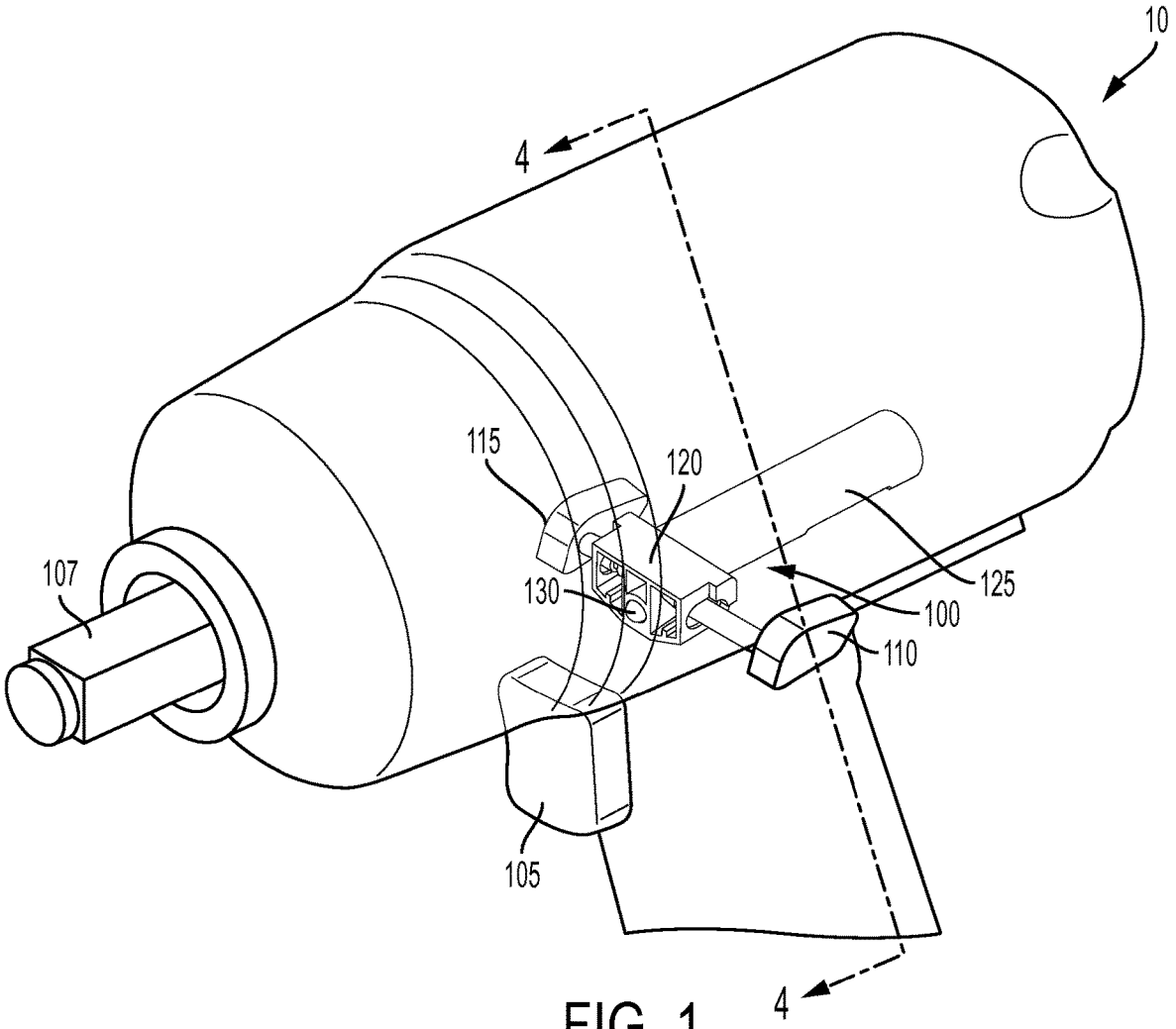
FIG. 1 is a front perspective view of a tool incorporating a reversing mechanism according to an embodiment of the present invention.
Figure 2A:
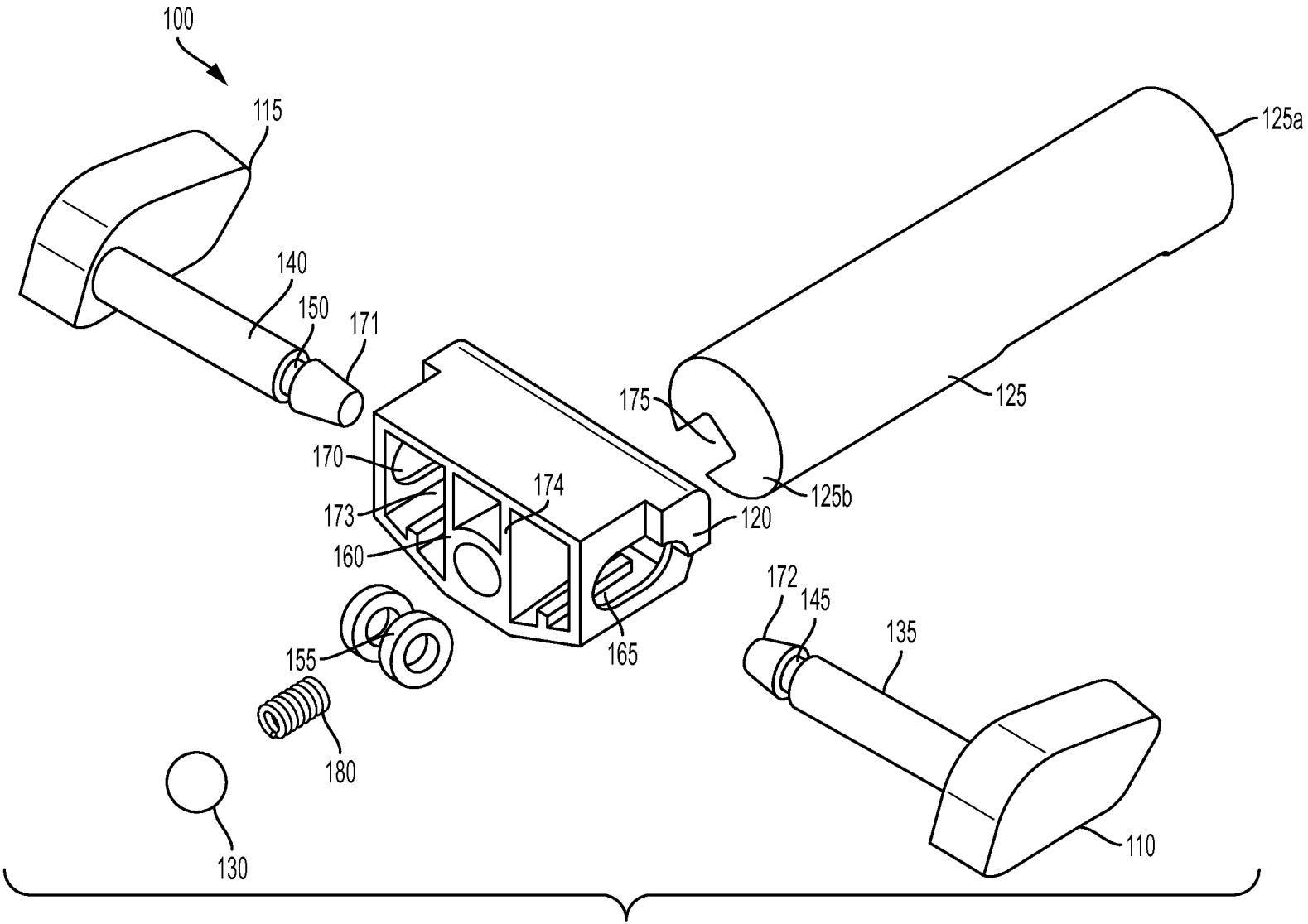
FIG. 2A is an exploded front perspective view of a reversing mechanism according to an embodiment of the present invention.
Figure 2B:
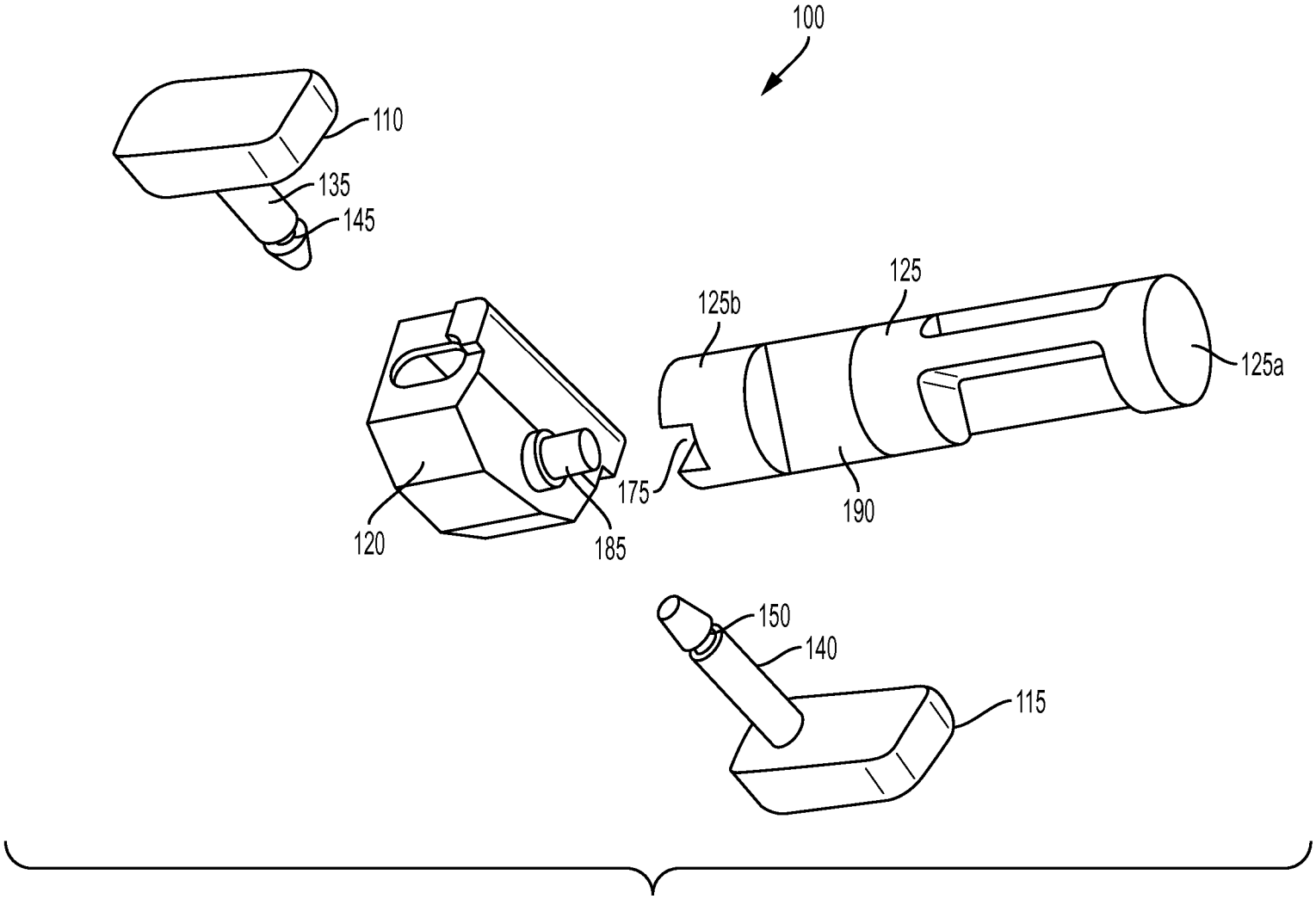
FIG. 2B is an exploded rear perspective view of a reversing mechanism according to an embodiment of the present invention.
Figure 3A:
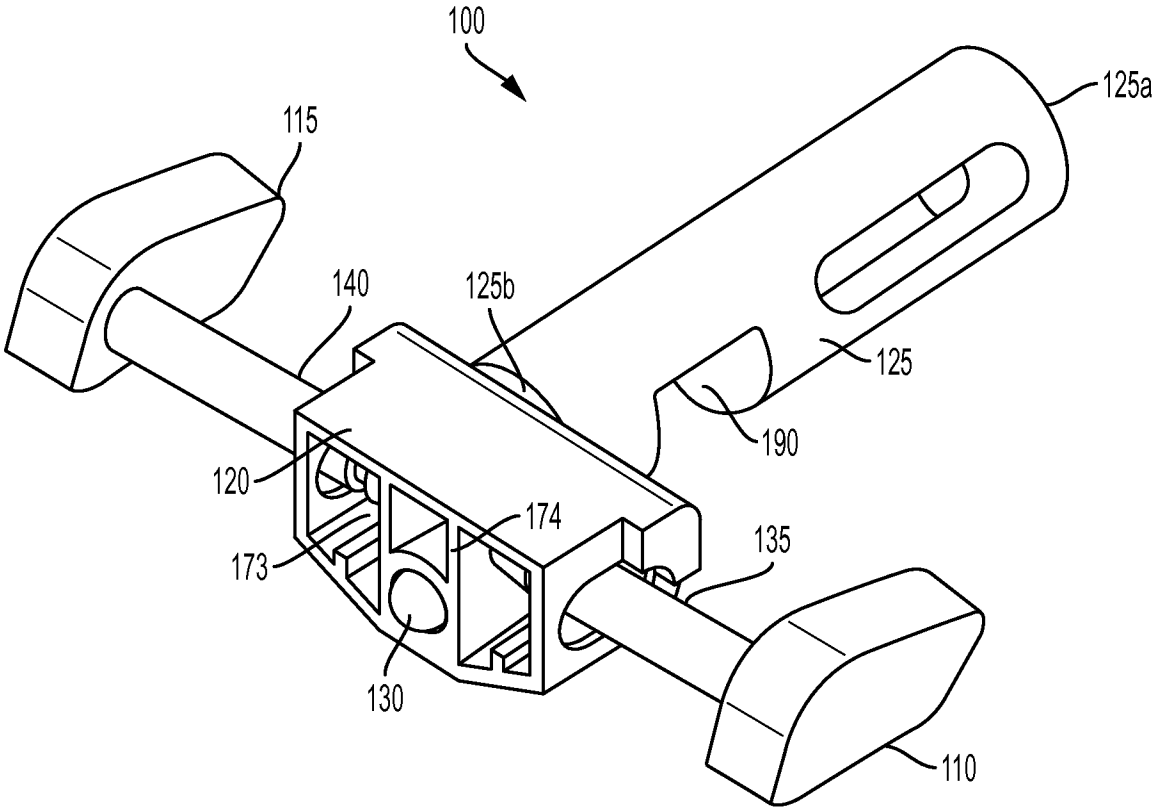
FIG. 3A is an assembled front perspective view of a reversing mechanism according to an embodiment of the present invention.
Figure 3B:
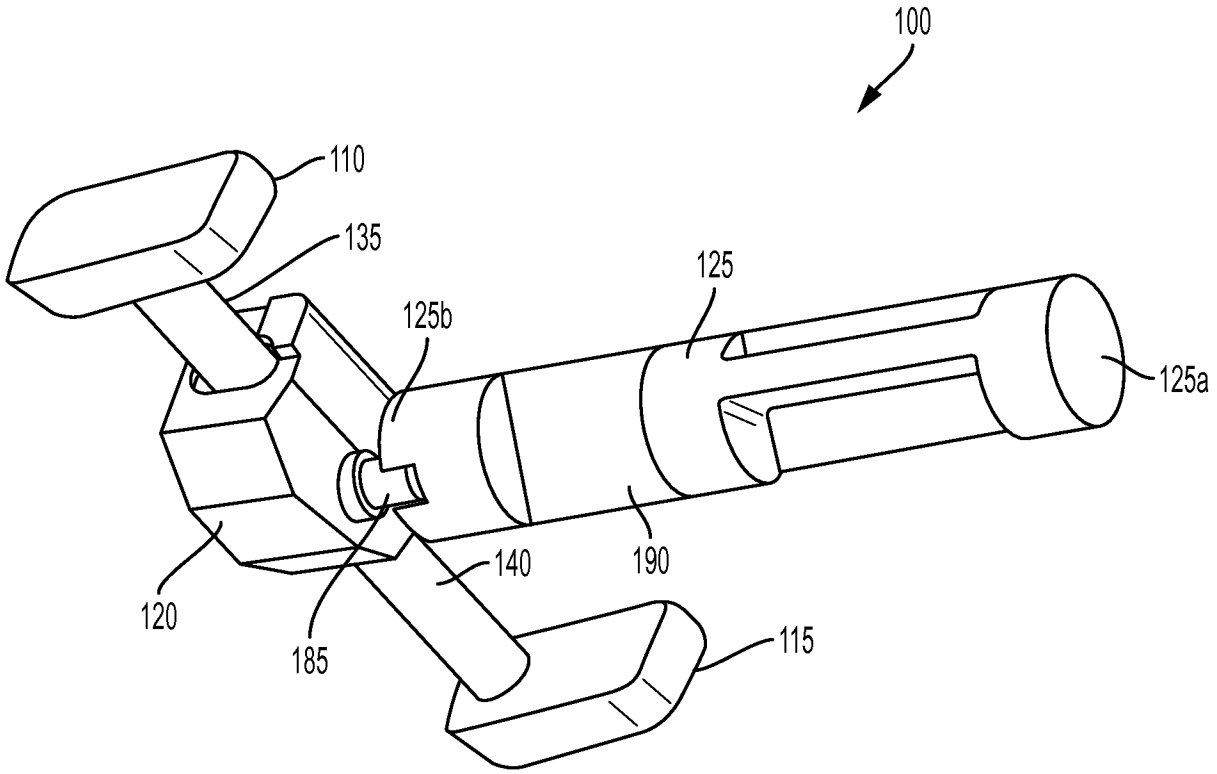
FIG. 3B is an assembled rear perspective view of a reversing mechanism according to an embodiment of the present invention.

While the present invention is susceptible of embodiments in many different forms, there is shown in the drawings, and will herein be described, embodiments of the invention, including a preferred embodiment, with the understanding that the present disclosure is to be considered as an exemplification of the principles of the invention and is not intended to limit the broad aspect of the invention to any one or more embodiments illustrated or disclosed.

An embodiment of the present invention comprises a reversing mechanism for a pneumatic or hydraulically operated tool. The reversing mechanism allows a user to selectively change the rotational direction of a motor having a rotor disposed in the tool by depressing one of first and second buttons respectively disposed on opposing first and second sides of the tool. The buttons can be coupled to a base internally disposed in the tool that, when actuated, causes rotation of a valve rotatably or movably coupled to the base and shift a barrier disposed on the valve to cause pressurized fluid or air to travel in a direction tangential to the selected rotational direction of the tool. The barrier selectively directs pressurized air or fluid from an external source and more efficiently causes the air or fluid to rotate a rotor disposed in a motor housing in a desired rotational direction by being angled substantially tangential to the desired rotational direction of the rotor. It will be appreciated that while the present invention is discussed generally as applicable to pneumatically powered tools, the present invention is applicable and adaptable to any type of tool that uses pressurized air or fluid, such as hydraulically powered or other tools.

Referring to FIG. 1, a tool 10, such as a pneumatic impact wrench having an output lug 107, includes a trigger 105 disposed adjacent to a handle that can be actuated by a user to cause pressurized air from an external supply to operate the tool 10. The output lug 107, can be coupled to other devices, such as a socket, to apply torque to a work piece in a well-known means. The trigger 105 can be biased such that the user can depress the trigger 105 inwardly, relative to the tool 10, to cause the tool 10 to operate by pneumatic or fluid power, and release the trigger 105, wherein the biased nature of the trigger 105 causes the trigger 105 to move outwardly, relative to the toll 10, to end the tool's operation. To change the rotational direction of the output lug 107, the user can depress either of first or second buttons 110, 115 respectively disposed on opposing first and second sides of the tool 10. For example, depressing the first button 110 can cause the output lug 107 to rotate in a first or clockwise rotational direction, and depressing the second button 115 can cause the output lug 107 to rotate in a second or counterclockwise rotational direction. In some embodiments, the first and second buttons 110, 115 are disposed near the trigger 105 within easy reach of a user's fingers during operation of the tool 10, so the user can change the rotational direction by depressing either of the first and second buttons 110, 115 without disengaging the tool 10 from a work piece.

In some embodiments, the first and second buttons 110, 115 are operatively coupled together so that only one of the first and second buttons 110, 115 can be depressed at a time. In such an embodiment, depressing the first button 110 inwardly relative to the tool 10 causes the second button 115 to move outwardly relative to the tool 10. Likewise, depressing the second button 115 inwardly relative to the tool 10 causes the first button 110 to move outwardly relative to the tool 10. For example, the first and second buttons 110, 115 can be rotatably or movably coupled to a base 120 disposed within the tool 10. The base 120 serves as the structural backbone of the reversing mechanism 100. The base 120 is coupled to a valve 125 that extends from the base 120 toward a rear of the tool 10. The valve 125 is rotatably coupled to the base 120 such that translational movement of the base 120 causes the valve 125 to rotate about an axis of the valve 125 and selectively distribute air or fluid to cause a clockwise or counterclockwise direction of a rotor disposed within the tool 10.

Referring to FIGS. 2A-3B, the reversing mechanism 100 includes first and second buttons 110, 115 movably coupled to a base 120. The first and second buttons 110, 115 respectively include first and second button arms 135, 140 extending into the base 120. The first and second button arms 135, 140 respectively include first and second button grooves 145, 150, that respectively couple with first and second retention members 155, 160, thereby retaining the ends of the first and second arms 135, 140 in and operably coupling to the base 120. For example, the first and second arms 135, 140 are disposed so that first and second button groves grooves 145, 150 respectively extend through first and second base openings 165, 170, wherein the first and second retention members 155, 160 respectively circumferentially engage first and second grooves 145, 150 to retain and operably couple the first and second arms 135, 140 to the base 120.

The first and second retention members 155, 160 can have an outer diameter larger than the diameter of the first and second base openings 165, 170 such that the retention members 155, 160 retain the ends of the first and second button arms 135, 140 within the base 120 and operatively couple the button arms 135, 140 to the base 120, and further prevent the button arms 135, 140 from being disengaged from the base 120. Further, the button arms 135, 140 can have button arm ends 171, 172 that respectively push against first and second base walls 173, 174 when the relevant button 110, 115 is pushed inwardly towards the base 120. Alternately, the buttons 110, 115 can have a second retention member disposed on the button arms 135, 140 outside of the base 120 to further operatively couple the button arms 135, 140 to the base 120 and allow the button arms 135, 140 to push the base 120 when the relevant button 110, 115 is pushed inwardly. Accordingly, movement of the buttons 110, 115 causes movement of the base 120 and, by extension, rotational movement of the valve 125.

The first and second retention members 155, 160 can be any structure or device that prevents the button arms 135, 140 from being disengaged from the base 120. For example, the retention members 155, 160 can be washers, spring washers, retaining rings, spring clips, cotter pins, or any other device or structure that can operatively couple the button arms 135, 140 with the base 120.

The valve 125 can include a first end **125*a* distal to the base 120, and a second end 125*b* proximate to the base 120. The valve 125 can be rotatably coupled to the base 120 at or near the second end 125*b*. For example, the valve 125 can include a slot 175 where the valve 125 couples with the base 120 in any manner, for example, by rotatably coupling to a pin. The valve 125 can be operatively coupled to the tool 10 on the first end 125*a* in a rotatable manner, or can be freely rotating without any coupling at the first end 125*a***.

The base 120 can include a pin 185 that couples with the slot 175 and allows the valve 125 to rotate relative to base 120. Alternately, the valve 125 can include a pin and can be coupled to the base 120, either in a slot of the base 120 or otherwise. For example, the valve can have a radial dimension and an axial dimension, as shown. The base 120 can be coupled to the valve 125 at a substantially outermost radial portion of the radial dimension such that linear movement of the valve 125 perpendicular to the axial direction causes rotational movement of the valve about an axis of the valve 125. For example, the pin 185 can be coupled to the slot 175 at an outermost radial portion of the valve 125. In this manner, linear movement of the base 120 will be in a direction tangential or nearly tangential to the circumference of the valve 125, and will move the valve 125 rotationally.

Figure 4A:
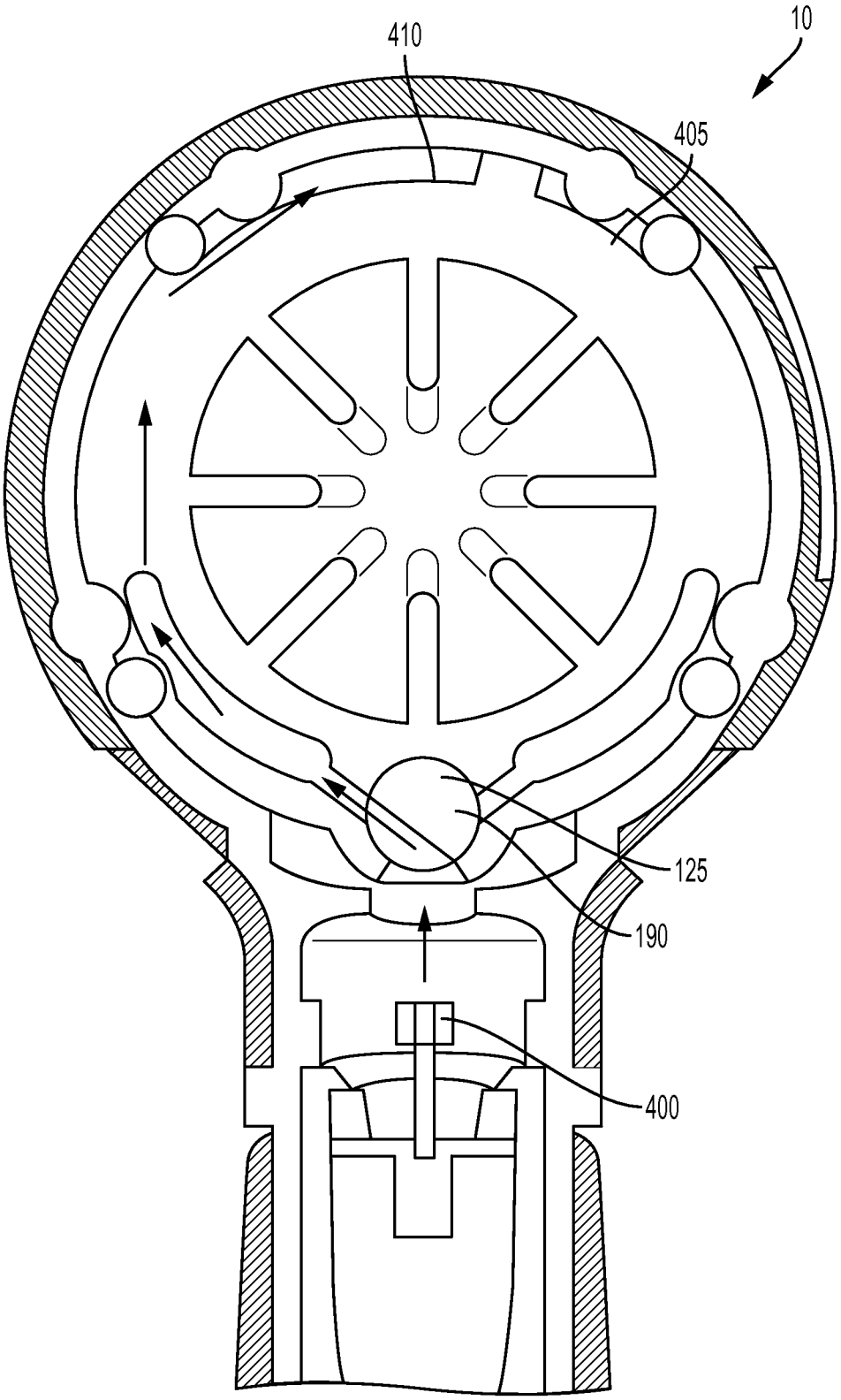
FIG. 4A is a rear sectional view of a tool with air flowing in a clockwise direction according to an embodiment of the present invention, taken along line 4-4 in FIG. 1.
Figure 4B:
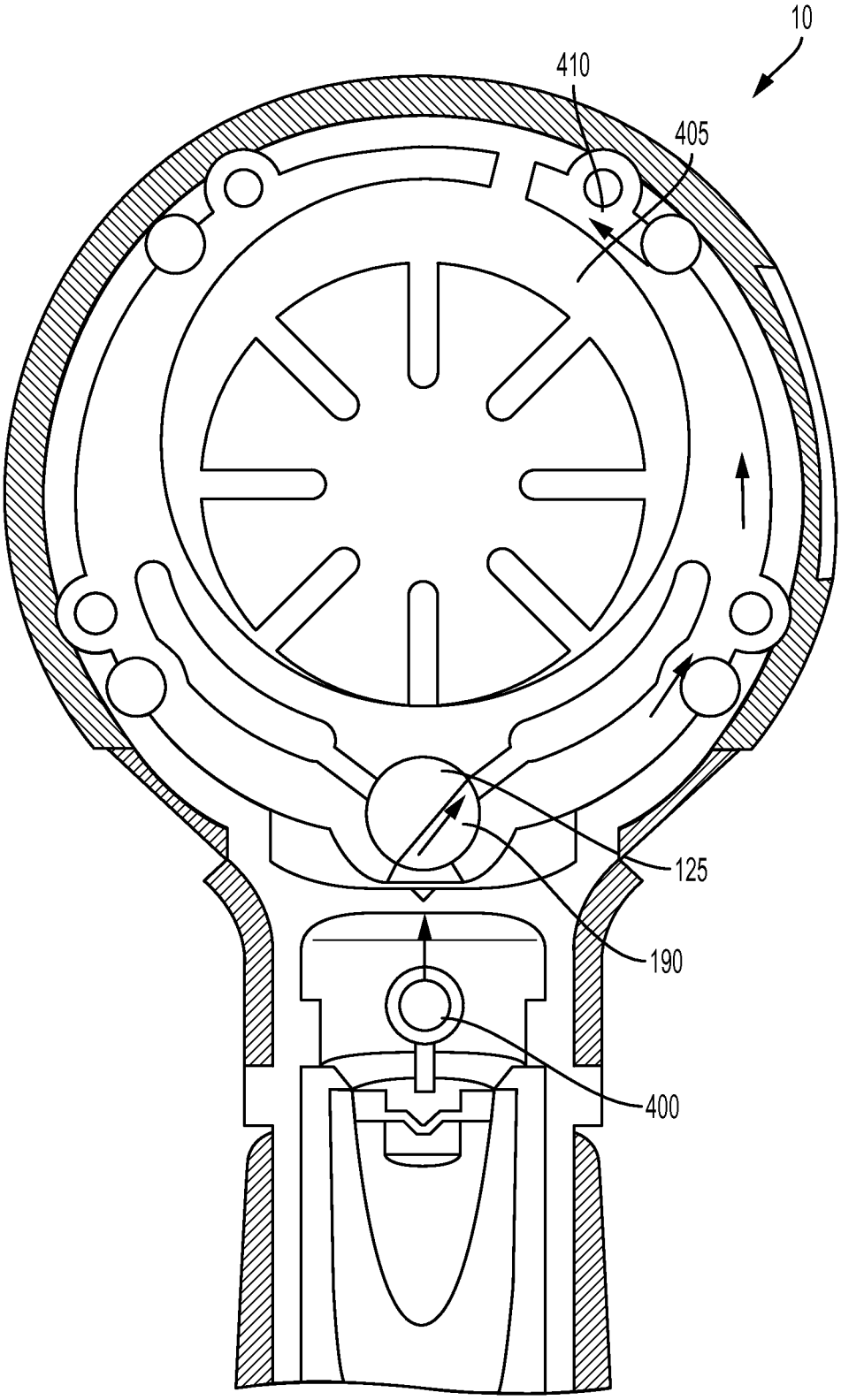
FIG. 4B is a rear sectional view of a tool with air flowing in a counterclockwise direction according to an embodiment of the present invention, taken along line 4-4 in FIG. 1.

The valve 125 can include a barrier 190 that selectively directs the flow of pressurized air or fluid from an external source 400 to within the tool 10, as shown in FIGS. 4A and 4B. As shown in FIG. 4A, the air or fluid can flow from the source 400 to the rotor 405 of the motor to cause rotation in a first direction, such as clockwise, by depressing, for example, the first button 110. Similarly, and as shown in FIG. 4B, depressing the second button 115 can cause the valve 125 to rotate in the opposite direction of that shown in FIG. 4A, causing air or fluid to flow tangentially in a second or counterclockwise direction.

The process for selecting a rotational direction tool 100 will now be discussed with reference to FIGS. 4A and 4B. As discussed, depressing either of the first and second buttons 110, 115 causes the base 120 to move linearly along a direction perpendicular to an axis of the valve 125, thereby causing the valve 125 to rotate. In doing so, because the pin 185 is coupled to the valve 125 at an outer circumference of the valve 125, the valve 125 will move rotationally relative to the base 120 when the base 120 is moved linearly by the user pushing one of the buttons 110, 115.

Rotating the valve 125 causes rotation of the barrier 190 within the tool 10 and selects the rotational direction of the tool. For example, the barrier 190 can be aligned to the rotational direction of air flow to distribute the air through the rotor 405 along a circumferential channel 410. The barrier 190 can be a flat or ramped surface extending in a radial direction of the valve 125 to better direct the air in the direction substantially tangential to the desired rotational direction of the tool 100 to more efficiently distribute the air. As shown in FIG. 4A, the barrier 190 directs air flow from the air source 400 tangentially towards the left side of the rotor 405, causing the tool 100 to rotate in a clockwise direction. Similarly, as shown in FIG. 4B, the barrier 190 can direct air tangentially towards the right side of the rotor 405 to cause the air to flow in a counterclockwise direction.

Figure 5:
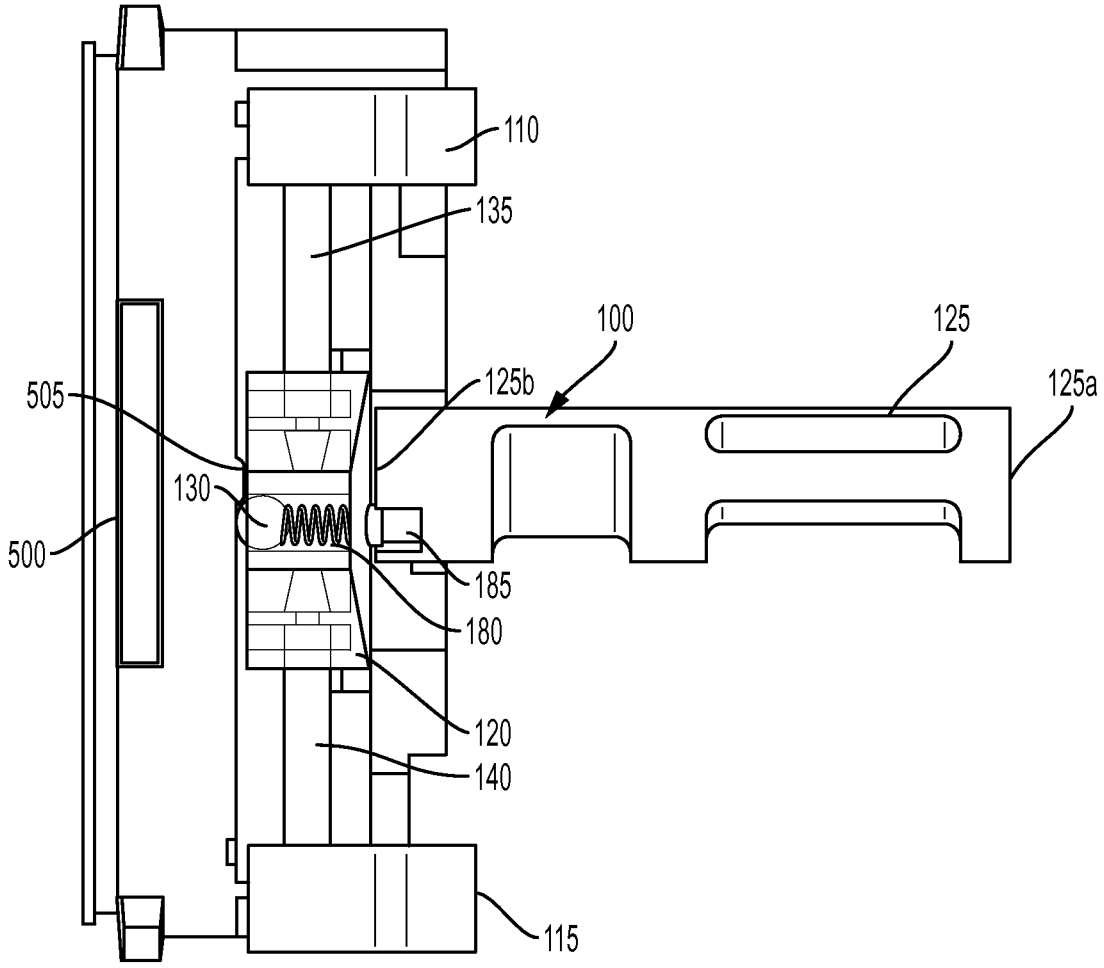
FIG. 5 is a partial sectional view of a reversing mechanism interacting with a motor plate according to an embodiment of the present invention.

The reversing mechanism 100 can also include a tactile response mechanism that notifies the user when the user has successfully reversed the rotational direction of the tool. For example, as shown in FIG. 5, a motor plate 500 can include a ramp 505 that the ball 130 can roll across when the rotational direction is selected by the user. When the user depresses the first or second buttons 110, 115, the base 120 moves linearly in a direction substantially perpendicular to an axis of the valve 125. In doing so, the ball 130 creates a snap-action when it rides over the ramp 505 to provide tactile feedback to the user to notify the user that the selected rotational direction of the tool 10 is in place. For example, when the ball 130 rides over the ramp 505 and provides a snap-action, the base 120, valve 125, and barrier 190 are each in the necessary position to direct air to cause the selected rotational direction. In an embodiment, the ball 130 can be biased away from the base 120 to provide tactile notification of when a rotational direction has been selected by the user. The ball 130 can be biased against the base 120 by a biasing or elastic member 180. When a user pushes either of first and second buttons 110, 115, the ball 130 can provide tactile feedback and indication to the user that the desired rotational direction of the tool 10 has been selected. The ball 130 can provide a snap-type action due to the bias from the bias member 180, thereby providing the tactile indication to the user. As shown, the bias member 180 is a coil spring, but the bias member 180 can be a leaf spring, torsion or double torsion spring, tension spring, compression spring, tapered spring, or simply an object elastically biased against the ball 130. Further, the elastic member 180 need not be a spring, or even an elastically biased device, and can be any device that applies an electrical, magnetic, mechanical, or any other type of force to the ball 130 to provide tactile feedback to the user. Any other implementation of the elastic member 180 can be carried out without departing from the spirit and scope of the present invention.

Figure 6:
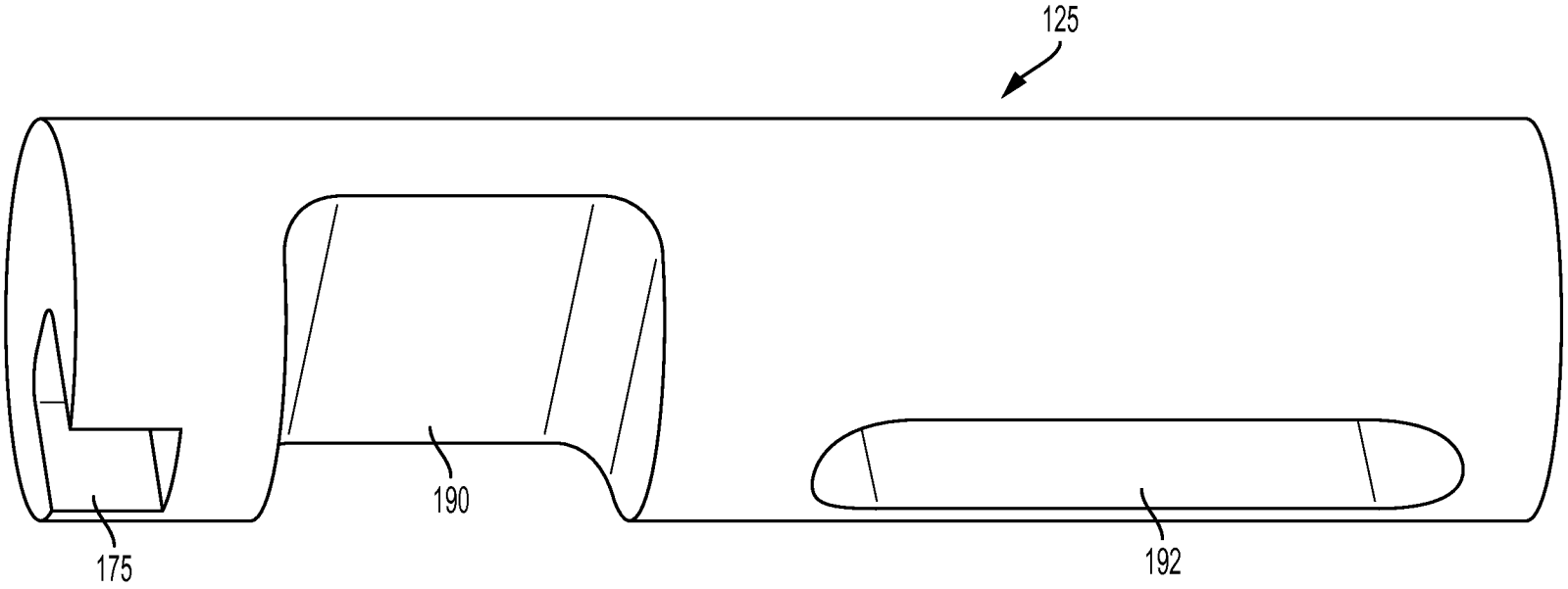
FIG. 6 is a front perspective view of a valve according to an embodiment of the present invention.

FIG. 6 illustrates the valve 125 of the present invention. As discussed, the valve 125 includes slot 175 for coupling with the pin 185 and a barrier 190 for directing air into a motor so that the air can cause the rotor to rotate in either a clockwise or counterclockwise directions. The valve 125 can also include a passage 192 to allow exhaust air to exit. The above structure allows better air flow in the tool 10 by implementing a passage 192 to exhaust air after passing through the rotor. The passage 192 also allows other portions of the tool housing to act as replacements for early and late stage exhaust ports. This exhaust structure is different than conventional tools which allow excess air to "bleed off" in that the air of the exhaust structure has already traveled through the motor, causing the rotor to turn, and is being exhausted afterward. Conventional tools bleed off excess air prior to the air completing a cycle through the motor so as to limit the power output of the motor.

As is known in the art, an air motor needs early and late exhaust ports. These are sometimes referred to as primary (early) and secondary (late) exhaust ports. The primary ports are typically apertures approximately diametrically opposed of the inlet. Secondary ports are later in the expansion process of the motor.

In a reversible motor, the inlet ports in the counterclockwise direction become the secondary exhaust ports in the clockwise direction, and vice versa, creating challenges for the tool designer. The valve 125 of the present application solves this problem by having a forward section of the valve 125 control the inlet gas flow (for example, by virtue of the barrier 190) and a rear section control the exhaust air flow (for example, by virtue of the passage 192). This allows a single air-flow pocket 205 in the cylinder assembly act as either the inlet or the secondary exhaust and improve air flow in the tool 10.

Figure 7:
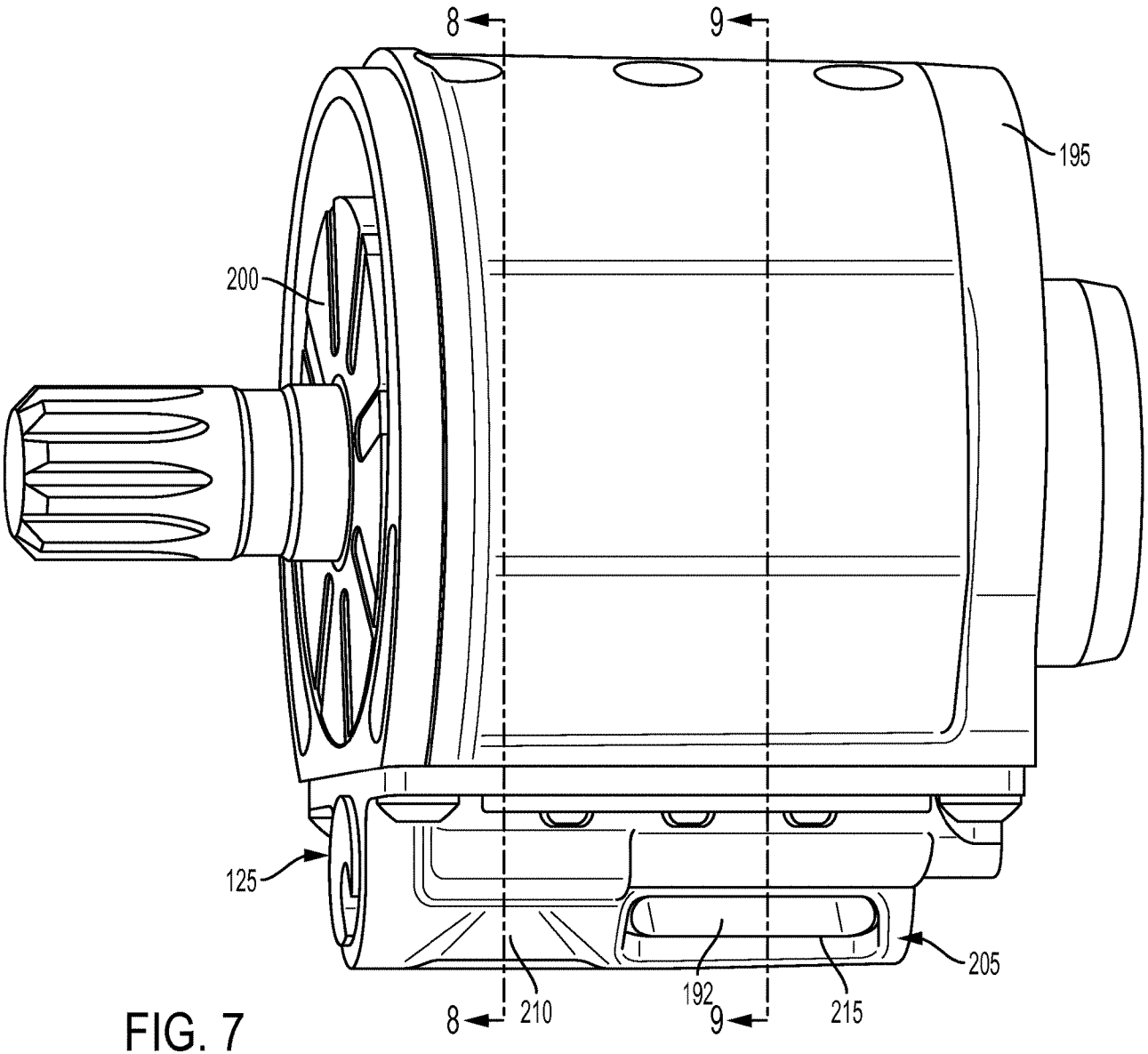
FIG. 7 is a side perspective view of a portion of the tool according to an embodiment of the present invention.

FIG. 7 illustrates the valve 125 as assembled into a larger portion of the tool 10. As shown, the tool 10 can include a cylinder 195 having a rotor 200 that rotates so as to impart torque upon the drive lug 107 and, by extension, on a work piece. The valve 125 can be rotatably disposed within a plate 205 and adapted to rotate so as to allow the barrier 190 to direct air in a desired direction. The plate 205 can include an inlet 210 and exhaust 215 for receiving air and exhausting air from the cylinder 195, respectively.

Figure 8:
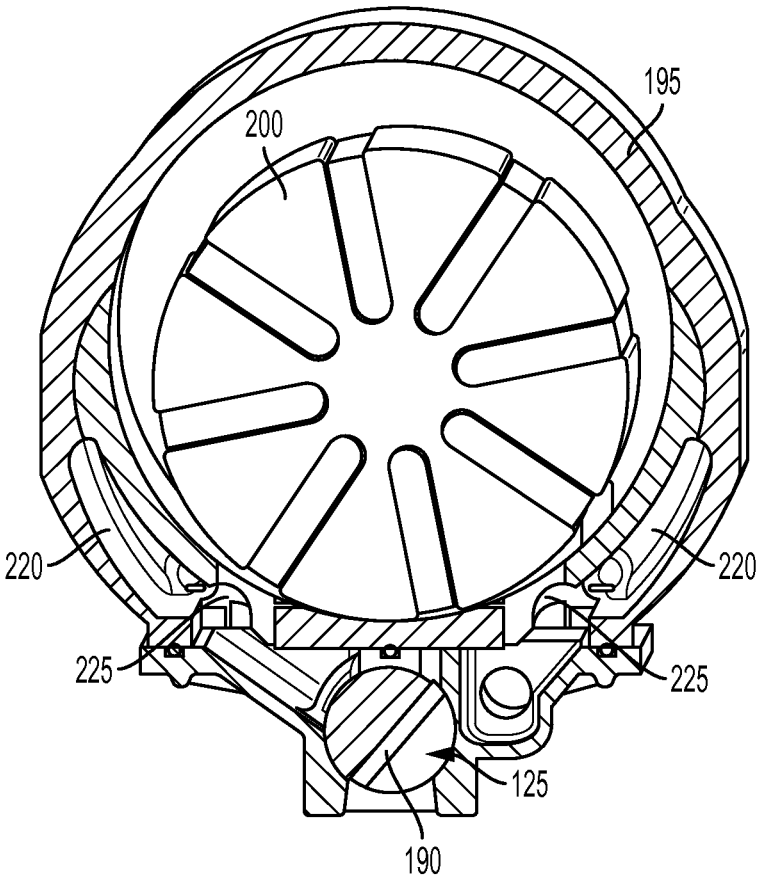
FIG. 8 is a rear sectional view of the portion of the tool taken from line 8-8 in FIG. 7.
Figure 9:
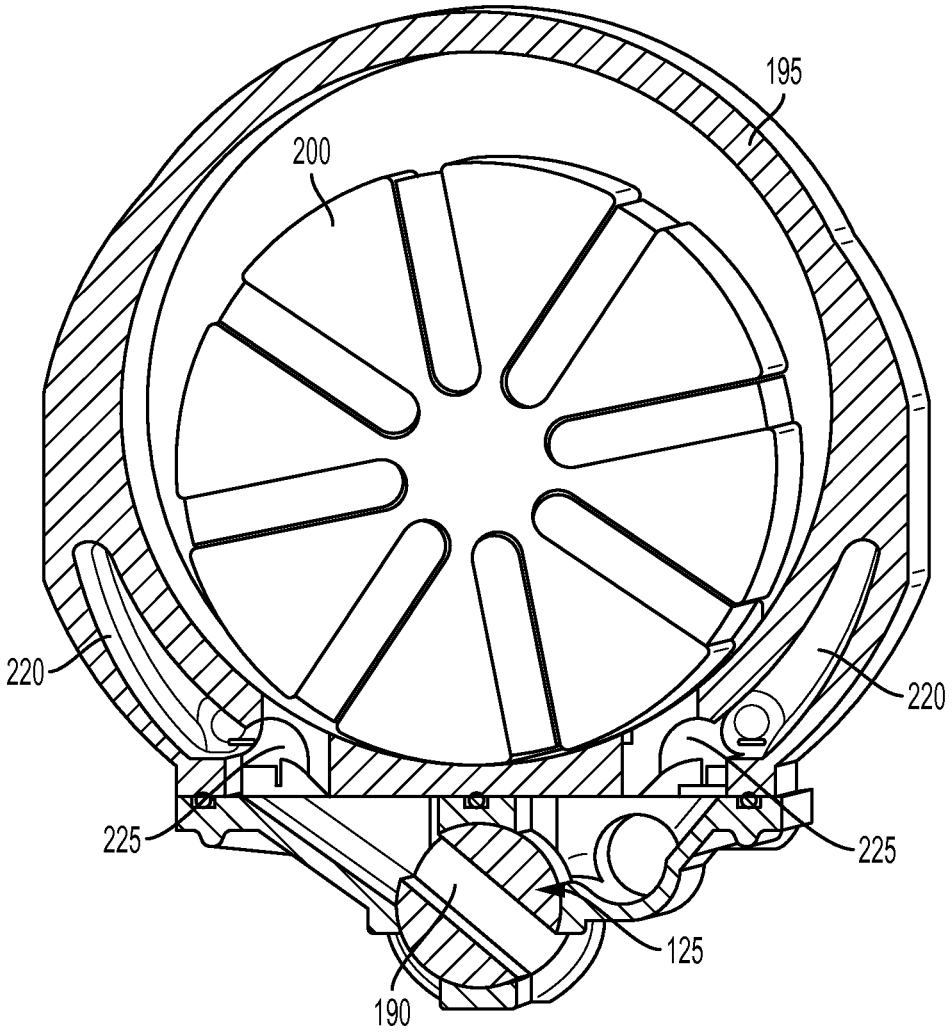
FIG. 9 is a rear sectional view of the portion of the tool taken from line 9-9 in FIG. 7.

FIGS. 8 and 9 illustrate the valve 125 directing air in the counterclockwise direction. As shown, the valve 125 directs the air, via the barrier 190, toward a right side of FIG. 8 so as to rotate the rotor 200 in the counterclockwise direction. The air can initially enter an initial pocket 220 instead of a primary exhaust port, and exit through a secondary pocket 225 instead of a secondary exhaust port. In some embodiments, the initial 220 and secondary 225 pockets are a unitary structure, in other words, a single pocket shaped to receive air at both the inlet and exhaust. Once air passes by the secondary pocket 225, it can escape through the passage 192. Although FIGS. 8 and 9 illustrate this arrangement with a counterclockwise rotational direction of the rotor 200, it should be appreciated that the same structure and process can be implemented with a clockwise rotation of the rotor 200, with the above structures reversed.

The above structure allows for a single air flow pocket in the assembly shown in FIGS. 8 and 9. That is, the pockets 220, 225 can in fact be a single pocket divided in to an inlet portion (e.g., the inlet pocket 220) and an outlet portion 225 (e.g., the outlet pocket). The valve 125 can then act as the entry and exit point of air into the cylinder 195 by directing air toward the inlet 210 with the barrier 190, and allowing air to exit through the outlet 215 via the passage 192. The above structure allows for greater air flow through the assembly and the tool 10 as a whole, creating greater efficiency and providing greater power output to the drive lug 107.

As discussed herein, the tool 10 can be a pneumatic tool such as an impact wrench. However, the tool 10 can be any pneumatically or hydraulically powered or hand-held tool, such as a ratchet wrench, torque wrench, impact wrench, drill, saw, hammer, or any other tool.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A tool powered by air or fluid, comprising:
- a motor having a rotor that rotates in either of first and second rotational directions;
- first and second buttons respectively disposed on first and second opposing sides of the tool and operatively coupled to a base disposed in the tool; and
- a valve rotatably coupled to the base, wherein axial movement of either of the first and second buttons causes the valve to rotate, and wherein the valve includes a barrier that directs at least a portion of the air or fluid to the rotor to cause the rotor to rotate in either of the first and second rotational directions, and a passage separate from the barrier and extending in a radial direction entirely through the valve that provides an exhaust flow path from the rotor.

2. The tool of claim 1, wherein the valve includes a slot and the base includes a pin, wherein the valve is rotatably coupled to the pin at the slot.

3. The tool of claim 1, wherein the base includes first and second openings, and the first and second buttons include respective first and second button arms that respectively extend into the first and second openings.

4. The tool of claim 3, wherein the first and second button arms respectively include first and second grooves, and first and second retention members respectively coupled around the first and second grooves.

5. The tool of claim 1, wherein the barrier directs at least the portion of the air or fluid in a direction tangential to the rotor.

6. The tool of claim 5, further comprising a circumferential channel disposed on the rotor and that is adapted to receive at least the portion of the air or fluid, and wherein the barrier directs air or fluid into the circumferential channel depending on whether the first and second buttons has been axially moved.

7. The tool of claim 6, wherein the valve includes radial and axial dimensions, and the base is coupled to the valve at an outermost radial portion of the radial dimension wherein linear movement of the base perpendicular to the axial direction causes rotational movement of the valve about an axis of the valve.

8. The tool of claim 1, further comprising a ball elastically biased away from the base, and a motor plate disposed to receive the ball and provide a tactile indication when either of the first and second rotational directions is selected.

9. The tool of claim 8, wherein the motor plate includes a ramp, and wherein the ball is disposed on a first side of the ramp when the first button is moved axially, and the ball is disposed on a second side of the ramp when the second button is moved axially.

10. A reversing mechanism for a tool powered by air or fluid and having a rotor operable in either of first and second rotational directions, the mechanism comprising:
- a base having first and second openings;
- first and second buttons respectively movably coupled to the base in the first and second openings; and
- a valve rotatably coupled to the base, wherein actuation of either of the first or second buttons causes the valve to rotate and respectively cause the first or second rotational directions, the valve includes a barrier that directs at least a portion of the air or fluid to the rotor, and a passage separate from the barrier and extending in a radial direction entirely through the valve that provides an exhaust flow path from the rotor.

11. The reversing mechanism of claim 10, wherein the valve includes a slot and the base includes a pin, wherein the valve is rotatably coupled to the pin at the slot.

12. The reversing mechanism of claim 10, wherein the first and second buttons respectively include first and second button arms that respectively extend into the first and second openings.

13. The reversing mechanism of claim 12, wherein the first and second button arms respectively include first and second grooves, and first and second retention members respectively circumferentially coupled around the first and second grooves.

14. The reversing mechanism of claim 13, wherein a diameter of the first and second retention members is respectively greater than a diameter of the first and second openings, thereby retaining ends of the first and second button arms in the base.

15. The reversing mechanism of claim 13, wherein the first and second retention members are respectively circumferentially coupled around the first and second grooves inside the base.

16. The reversing mechanism of claim 10, wherein the barrier directs at least the portion of the air or fluid in a direction tangential to the rotor.

17. The reversing mechanism of claim 10, wherein the valve has a radial dimension and an axial dimension, and the base is coupled to the valve at an outermost radial portion of the valve such that linear movement of the base perpendicular to the axial direction causes rotational movement of the valve about an axis of the valve.

18. An assembly for a tool powered by air or fluid, comprising:

a housing having an inlet pocket portion and an outlet pocket portion;

a cylinder housed by the housing and adapted to receive and exhaust air or fluid; and a rotatable valve having a barrier adapted to direct at least a portion of the air or fluid in a selected direction, and further having a passage separate from the barrier and extending in a radial direction entirely through the valve, wherein the valve is adapted to direct at least the portion of the air or fluid towards the inlet pocket portion, and allow a portion of the air or fluid to exhaust through the passage after passing the outlet pocket portion.

19. The assembly of claim 18, wherein the inlet pocket portion and the outlet pocket portion are a unitary pocket.

* * * * *